US012123594B1

(12) United States Patent
Borer

(10) Patent No.: US 12,123,594 B1
(45) Date of Patent: Oct. 22, 2024

(54) LIGHTER

(71) Applicant: Philipp Borer, Calgary (CA)

(72) Inventor: Philipp Borer, Calgary (CA)

( * ) Notice: Subject to any disclaimer, the term of this patent is extended or adjusted under 35 U.S.C. 154(b) by 448 days.

(21) Appl. No.: 17/537,582

(22) Filed: Nov. 30, 2021

(51) Int. Cl.
*F23Q 2/00* (2006.01)
*F23Q 2/16* (2006.01)
*F23Q 2/28* (2006.01)
*F23Q 3/01* (2006.01)

(52) U.S. Cl.
CPC ..... *F23Q 2/16* (2013.01); *F23Q 2/285* (2013.01); *F23Q 3/01* (2013.01)

(58) Field of Classification Search
CPC ..... F23Q 2/16; F23Q 2/285; F23Q 3/01
USPC ..... 431/153
See application file for complete search history.

(56) References Cited

U.S. PATENT DOCUMENTS 3,811,819 A * 5/1974 Toiseux ..... F23Q 2/285 431/255
3,884,614 A * 5/1975 Moriya ..... F23Q 2/285 431/88
3,918,887 A * 11/1975 Lamprecht ..... F23Q 2/285 431/255
3,970,420 A * 7/1976 Goto ..... F23Q 2/16 431/255
4,089,636 A * 5/1978 Goto ..... F23Q 2/285 431/255
4,102,631 A * 7/1978 Goto ..... G04G 17/08 968/844
4,179,260 A * 12/1979 Lowenthal ..... F23Q 2/285 431/255
5,839,892 A 11/1998 Hwang
6,589,045 B2 7/2003 Xu
7,387,510 B2 6/2008 Luo
7,748,978 B2 7/2010 Bao
9,046,267 B2 6/2015 Muste
10,378,766 B2 8/2019 Luo
10,648,665 B2 5/2020 Harel
10,845,054 B1 11/2020 Muste-Herrera
2004/0048215 A1* 3/2004 Wong ..... F23Q 2/163 431/344
2009/0162803 A1* 6/2009 Ruan ..... F23Q 2/32 431/253
2014/0076879 A1* 3/2014 Ye ..... F23Q 7/14 219/262

FOREIGN PATENT DOCUMENTS

WO WO-2015018347 A1 * 2/2015 ..... F23Q 3/01
WO 2018108254 6/2018

* cited by examiner

*Primary Examiner* — Avinash A Savani
(74) *Attorney, Agent, or Firm* — Kyle A. Fletcher, Esq.

(57) ABSTRACT

The lighter is an ignition device. The lighter includes a housing structure, a fuel system, and an ignition circuit. The housing contains the fuel system and the ignition circuit. The fuel system provides the ignition circuit with a supply of a hydrocarbon based fuel. The ignition system provides the fuel with a source of plasma that is used to initiate a combustion reaction that converts the fuel into a flame. The ignition system continuously provides the plasma to the fuel to ensure that the flame is continuously sustained.

17 Claims, 6 Drawing Sheets

LIGHTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighters generating a flame using a gas phase fuel that is stored in a liquid phase. (F23Q2/167)

SUMMARY OF INVENTION

The lighter is an ignition device. The lighter comprises a housing structure, a fuel system, and an ignition circuit. The housing contains the fuel system and the ignition circuit. The fuel system provides the ignition circuit with a supply of a hydrocarbon based fuel. The ignition system provides the fuel with a source of plasma that is used to initiate a combustion reaction that converts the fuel into a flame. The ignition system continuously provides the plasma to the fuel to ensure that the flame is continuously sustained.

These together with additional objects, features and advantages of the lighter will be readily apparent to those of ordinary skill in the art upon reading the following detailed description of the presently preferred, but nonetheless illustrative, embodiments when taken in conjunction with the accompanying drawings.

In this respect, before explaining the current embodiments of the lighter in detail, it is to be understood that the lighter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lighter.

It is therefore important that the claims be regarded as including such equivalent construction insofar as they do not depart from the spirit and scope of the lighter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
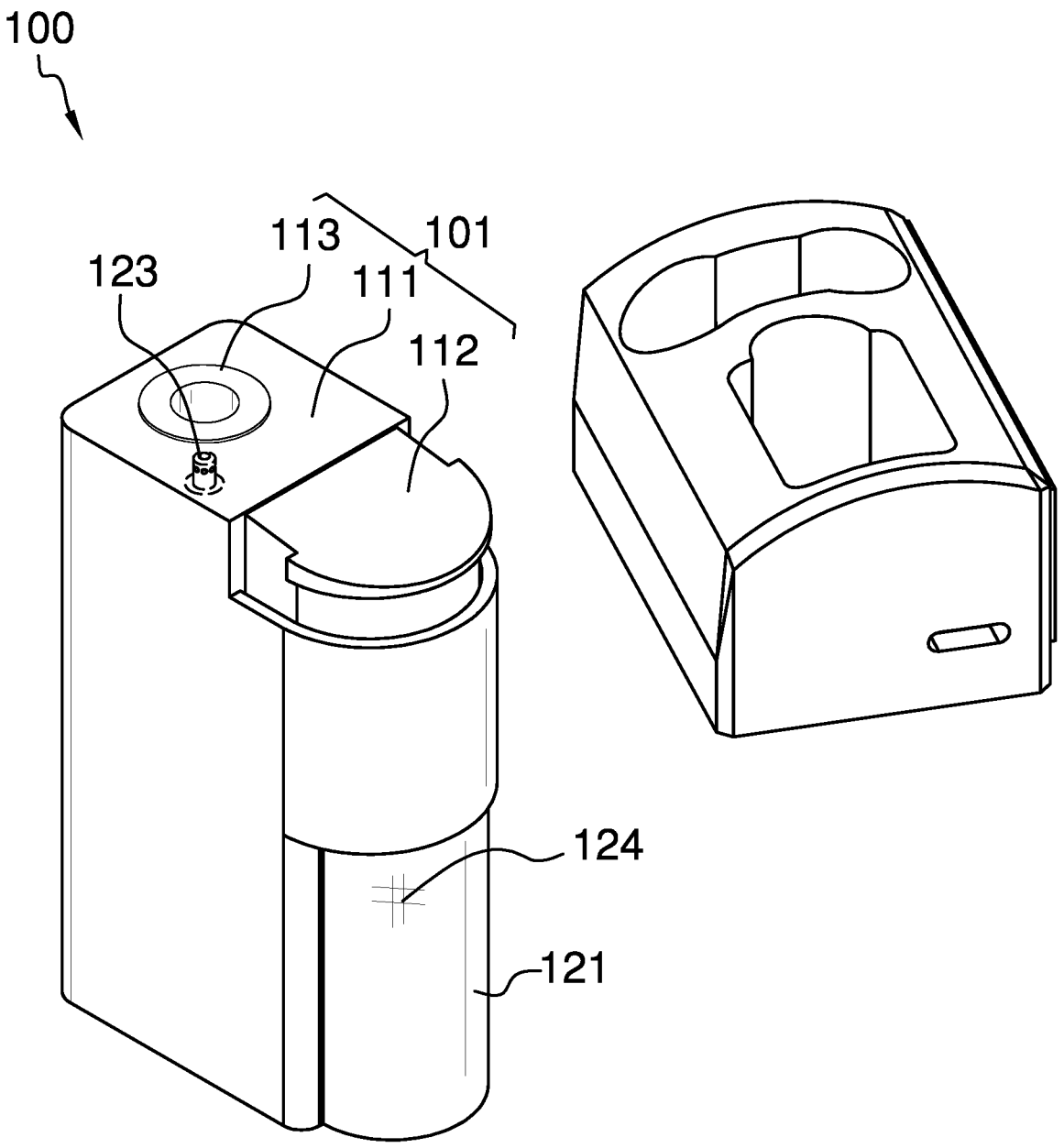
FIG. 1 is a perspective view of an embodiment of the disclosure.
Figure 2:
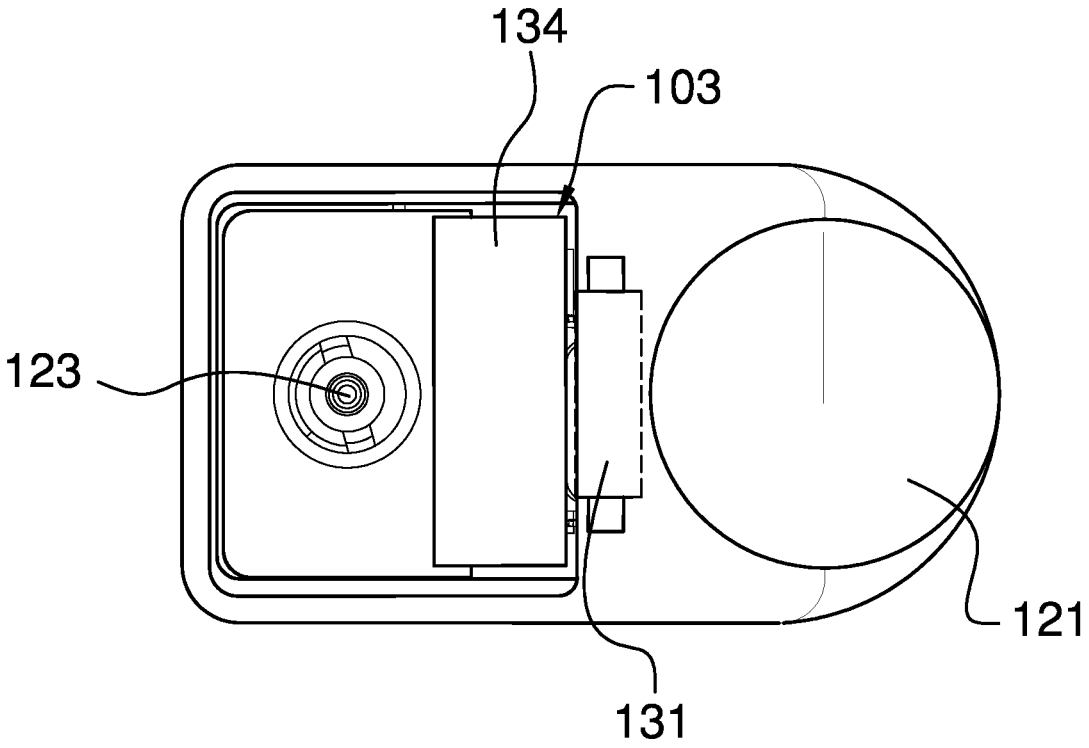
FIG. 2 is a bottom view of an embodiment of the disclosure.
Figure 3:
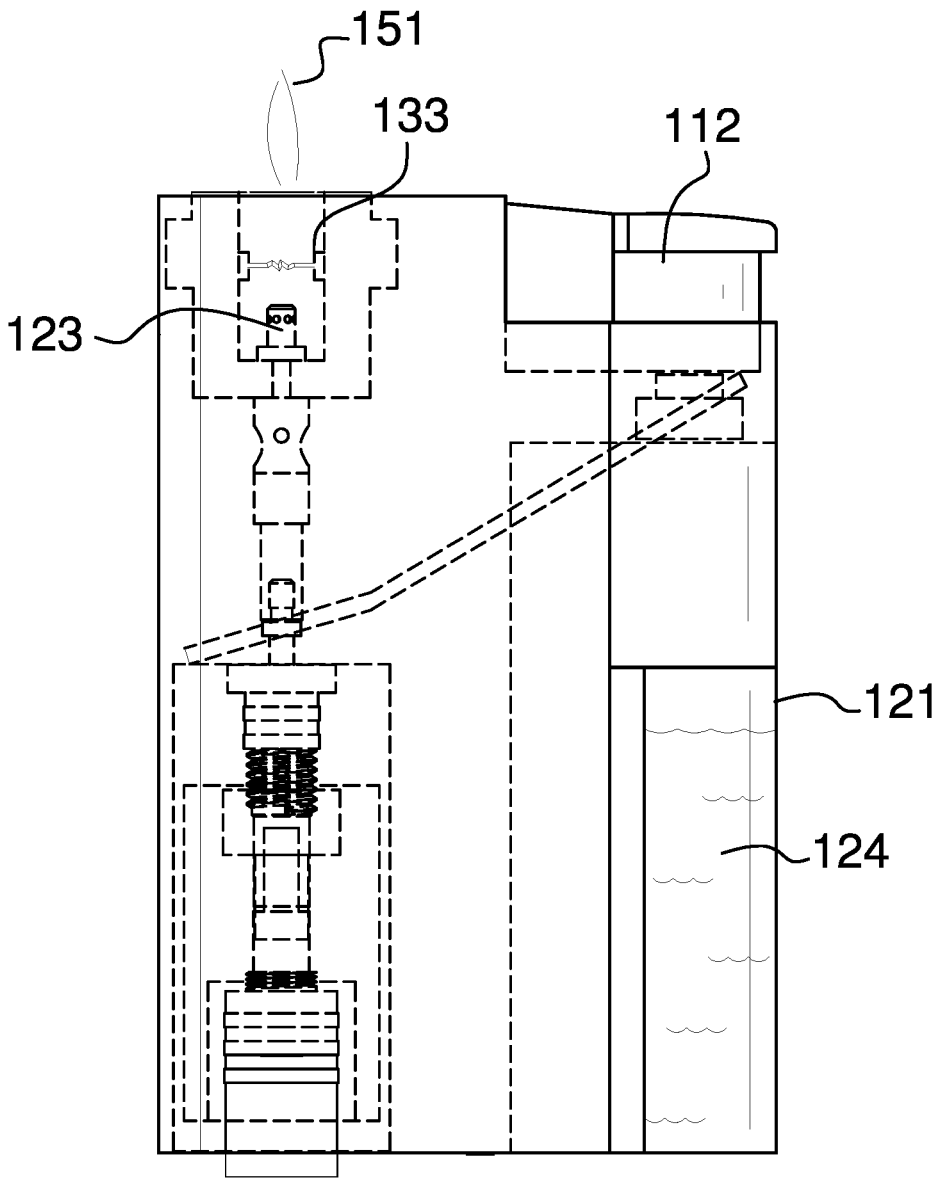
FIG. 3 is a side view of an embodiment of the disclosure.
Figure 4:
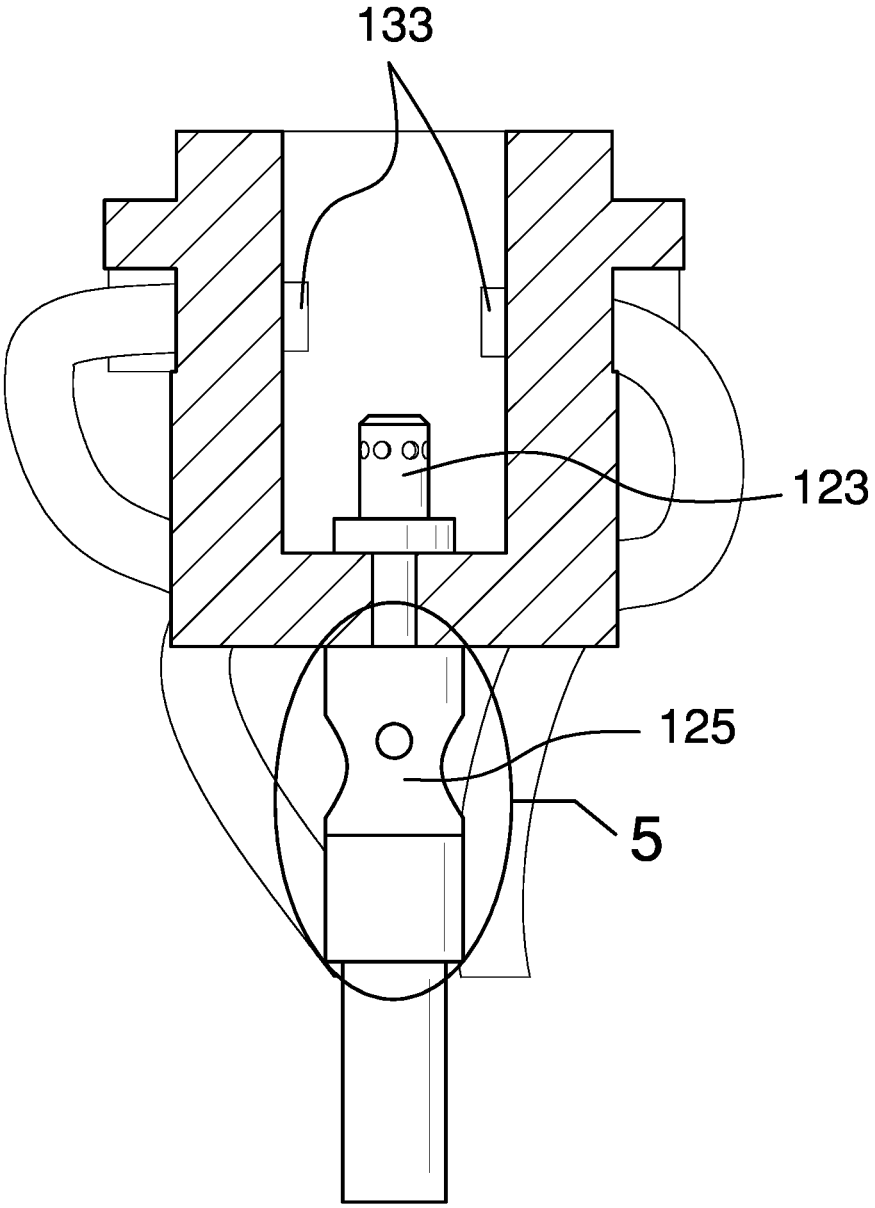
FIG. 4 is a detail view of an embodiment of the disclosure.
Figure 5:
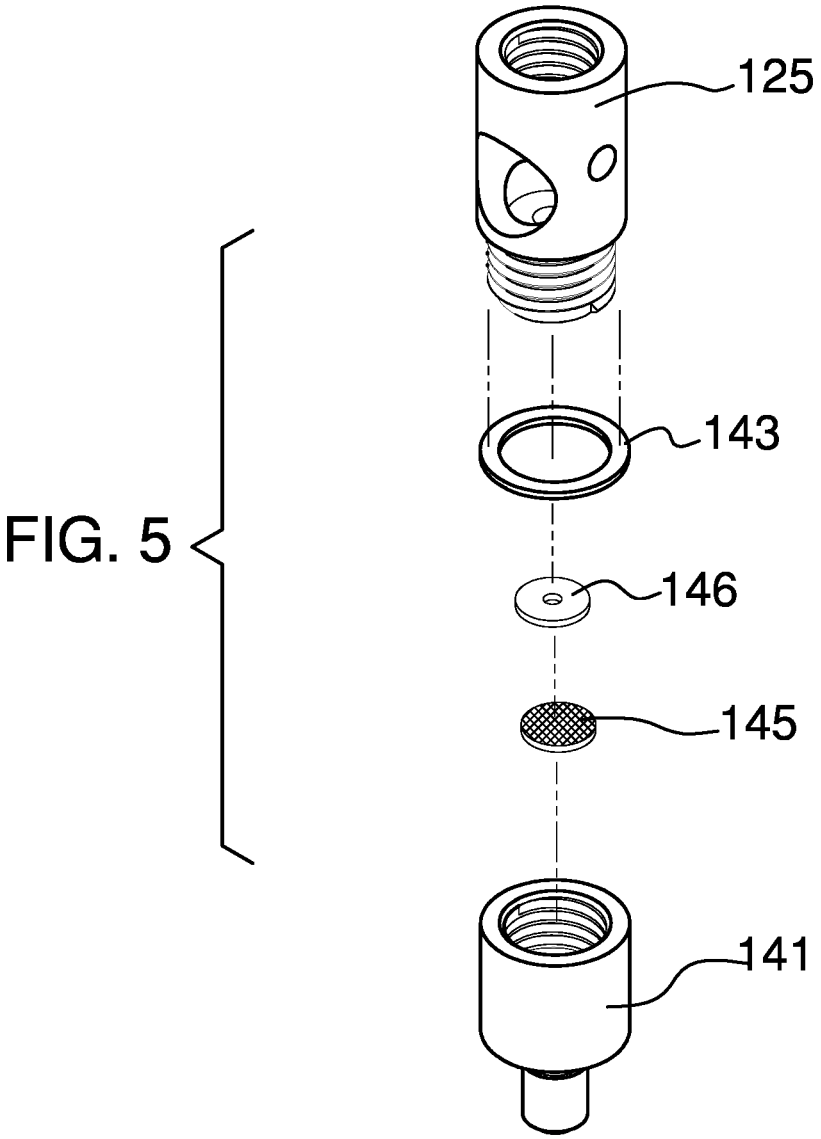
FIG. 5 is a detail view of an embodiment of the disclosure.
Figure 6:
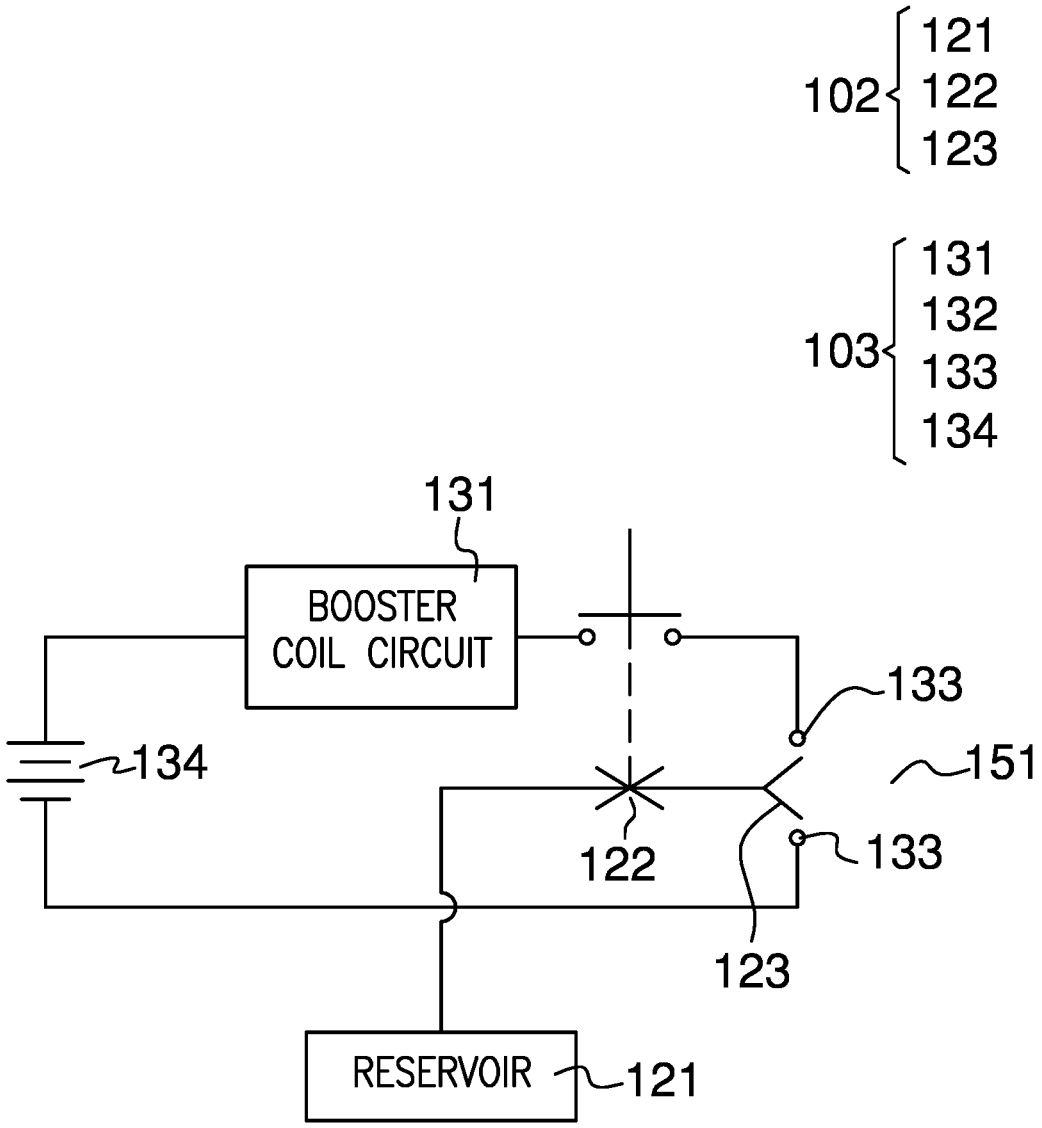
FIG. 6 is a schematic view of an embodiment of the disclosure.

Detailed reference will now be made to one or more potential embodiments of the disclosure, which are illustrated in FIGS. 1 through 6.

The lighter 100 (hereinafter invention) is an ignition device. The invention 100 comprises a housing structure 101, a fuel 124 system 102, and an ignition circuit 103. The housing structure 101 contains the fuel 124 system 102 and the ignition circuit 103. The fuel 124 system 102 provides the ignition circuit 103 with a supply of a hydrocarbon based fuel 124. The ignition circuit 103 provides the fuel 124 with a source of plasma that is used to initiate a combustion reaction that converts the fuel 124 into a flame 151. The ignition circuit 103 continuously provides the plasma to the fuel 124 to ensure that the flame 151 is continuously sustained. The flame 151 is a structure characteristic of a combustion reaction. The flame 151 is a visible structure that is formed from the portion of the gas products of the combustion reaction that are heated to the point where visible light is emitted.

The housing structure 101 is a rigid structure. The housing structure 101 contains the fuel 124 system and the ignition circuit 103. The housing structure 101 is formed with all apertures and form factors necessary to allow the housing structure 101 to accommodate the use and operation of the fuel 124 system and the ignition circuit 103. Methods to form a housing structure 101 suitable for the purposes described in this disclosure are well-known and documented in the mechanical arts. The housing structure 101 comprises a shell 111, a lever 112, and a burner well 113.

The shell 111 is a rigid structure. The shell 111 forms the exterior surfaces of the housing structure 101.

The lever 112 attaches to the exterior surface of the shell 111. The lever 112 is a mechanical structure. The lever 112 is a rotating structure. The lever 112 is manually rotated. The rotation of the lever 112 initiates the flow of fuel 124 through the fuel 124 system 102. The rotation of the lever 112 further initiates the operation of the ignition circuit 103.

The burner well 113 is a disk-shaped negative space that is formed within the shell 111. The burner well 113 is accessible from the exterior of the shell 111. The burner well 113 is positioned such that the gas phase fuel 124 released from the fuel 124 system 102 discharges into the burner well 113. The burner well 113 is positioned such that the plasma arc generated by the ignition circuit 103 ignites the fuel 124 as the fuel 124 flows into the burner well 113.

The fuel 124 system 102 is a mechanical system. The fuel 124 system 102 is a fluid storage and transport system. The fuel 124 system 102 stores fuel 124 under pressure and in a liquid phase. The fuel 124 system 102 transports and releases the fuel 124 in a gas phase into the burner well 113 of the housing structure 101 for combustion. The shell 111 comprises a reservoir 121, a valve 122, and a nozzle 123.

The reservoir 121 is a containment vessel. The reservoir 121 further comprises a fuel 124. The reservoir 121 stores the fuel 124 under pressure in anticipation of use. The reservoir stores the fuel 124 in a liquid phase. The fuel 124 is a hydrocarbon based substance. The fuel 124 is defined elsewhere in this disclosure. The fuel 124 is selected such that the fuel 124 has a gas phase under normal temperature and pressure conditions. The fuel 124 is stored as a liquid under pressure. The fuel 124 "flashes" (evaporates) to a gas phase when exposed to the atmosphere.

The valve 122 is a mechanically operated valve 122. The valve 122 is defined elsewhere in this disclosure. The valve 122 forms a fluidic connection between the reservoir 121 and the nozzle 123. The valve 122 controls the flow of fuel 124 to the nozzle 123. The valve 122 rotates between a closed position and an open position. The valve 122 permits the flow of fuel 124 from the reservoir 121 to the nozzle 123 when the valve 122 is in an open position. The valve 122 prevents the flow of fuel 124 from the reservoir 121 to the nozzle 123 when the valve 122 is in a closed position. The valve 122 mechanically attaches to the lever 112. The rotation of the lever 112 to a previously determined "operating" position actuates the valve 122 to the open position. The rotation of the valve 122 away from the operating position actuates the valve 122 to the closed position. The pressure of the fuel 124 within the reservoir 121 provides the motive forces that drive the fuel 124 through the valve 122 and into the nozzle 123.

The nozzle 123 is the port of the fuel 124 system 102 that discharges the fuel 124 into the burner well 113 of the housing structure 101. The nozzle 123 is formed to create a pressure drop in the fuel 124 as the fuel 124 is discharged into the atmosphere. The pressure drop through the nozzle 123 causes the fuel 124 to evaporate from a liquid phase into a gas phase as the fuel 124 is discharged from the nozzle 123. The nozzle 123 further comprises a nozzle 123 pan 141, a reservoir 121 port 142, an o-ring 143, a washer 144, a mesh filter 145, and a pinhole ring 146.

The nozzle 123 pan 141 is a pan shaped structure. The nozzle 123 pan 141 forms the primary exterior surface of the nozzle 123. The nozzle 123 pan 141 contains the reservoir 121 port 142, the o-ring 143, the washer 144, the mesh filter 145, and the pinhole ring 146.

The nozzle 123 receives the fuel 124 in a liquid phase from the valve 122 into the nozzle 123 pan 141 through the reservoir 121 port 142.

The o-ring 143 is a spacer. The o-ring 143 is an elastomeric structure. The o-ring 143 forms a fluid impermeable seal around the reservoir 121 port 142 that prevents the escape of fuel 124 from the reservoir 121 port 142.

The washer 144 is a spacer. The washer 144 is a rigid structure. The washer 144 supports the mesh filter 145 such that the fuel 124 flows through the washer 144 to reach the mesh filter 145.

The mesh filter 145 is a filter. The mesh filter 145 acts as a strainer that removes solids from the fuel 124 flow before the fuel 124 reaches the pinhole ring 146.

The pinhole ring 146 is a disk-shaped structure. The pinhole ring 146 forms a plate that encloses the open face of the pan structure of the nozzle 123 pan 141. The pinhole ring 146 has an aperture characteristic of a ring structure. The diameter of the characteristic aperture of the pinhole ring 146 is selected such that the pressure drop experienced by the fuel 124 as the fuel 124 passes through the pinhole ring 146 causes the fuel 124 to evaporate into the atmosphere.

The ignition circuit 103 is an electric circuit. The ignition circuit 103 ignites the flow of the fuel 124 to generate the flame 151 of a combustion reaction. The ignition circuit 103 ignites the fuel 124 using a plasma flow known as an arc. The ignition circuit 103 passes the arc through the flow of the fuel 124. The ignition circuit 103 continuously generates the arc as the fuel 124 is released from the fuel 124 system 102. The continuous arc generated by the ignition circuit 103 ensures that the fuel 124 discharged from the fuel 124 system 102 is completely consumed in the combustion reaction. The ignition circuit 103 comprises a booster coil 14 circuit 131, an ignition switch 132, an arc gap 133, and a battery 134. The booster coil circuit 131, the ignition switch 132, the arc gap 133, and the battery 134 are electrically 17 connected in a series circuit.

The booster coil circuit 131 is an electric circuit. The booster coil circuit 131 electrically connects to the ignition switch 132. The booster coil circuit 131 receives electric energy from the battery 134. The booster coil circuit 131 receives a voltage from the battery 134. The booster coil circuit 131 stores the received electric energy. The booster coil circuit 131 "multiplies" the voltage of the battery 134 such that the received electric energy is stored at a voltage greater than the voltage of the battery 134. The booster coil circuit 131 discharges the stored electric energy through the ignition switch 132 into the arc gap 133. The voltage of the electric energy stored by the booster coil circuit 131 is selected such that the electric energy will ionize the atmosphere when the electric energy is discharged through the arc gap 133. The ionization of the atmosphere by the electric energy released by the booster coil circuit 131 ignites the gas phase fuel 124 that has evaporated into the atmosphere to initiate the combustion reaction and the associated flame 151.

The ignition switch 132 is a momentary switch. The ignition switch 132 is defined elsewhere in this disclosure. The ignition switch 132 forms an electric connection between the booster coil circuit 131 and the arc gap 133. The ignition switch 132 controls the flow of electricity from the booster coil circuit 131 into the arc gap 133. The ignition switch 132 actuates between a closed position and an open position. The ignition switch 132 permits the flow of electricity from the booster coil circuit 131 from the arc gap 133 when the ignition switch 132 is in a closed position. The ignition switch 132 prevents the flow of electricity from the booster coil circuit 131 from the arc gap 133 when the ignition switch 132 is in an open position. The ignition switch 132 mechanically attaches to the lever 112. The rotation of the lever 112 to a previously determined "operating" position actuates the ignition switch 132 to the closed position. The rotation of the ignition switch 132 away from the operating position actuates the ignition switch 132 to the open position.

The arc gap 133 is formed from two leads that are exposed to the atmosphere in the burner well 113 of the housing structure 101. The arc gap 133 presents the electric energy at the multiplied voltage from the booster coil circuit 131 to the atmosphere in the burner well 113. The presentation of the multiplied voltage across the arc gap 133 ionizes the atmosphere causing an arc to form across the arc gap 133. The arc formed across the arc gap 133 ignites the gas phase fuel 124. The arc gap 133 forms an electrical connection between the ignition switch 132 and the battery 134.

The battery 134 is an electrochemical device. The battery 134 converts chemical potential energy into electrical energy used to power the ignition circuit 103. The arc gap 133 is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Filter: As used in this disclosure, a filter is a mechanical device that is used to separate solids that are suspended in a liquid or a gas. A strainer is a type of filter with what would be considered a coarse mesh measurement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Fuel: As used in this disclosure, fuel refers to a substance that undergoes a chemical combustion reaction to release chemical potential energy.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Housing: As used in this disclosure, a housing is a rigid structure that encloses and protects one or more devices.

Ignition Device: As used in this disclosure, an ignition device is an electrically or mechanically powered device that starts the operation of a piece of equipment that is powered using a combustion reaction.

Liquid: As used in this disclosure, a liquid refers to a state (phase) of matter that is fluid and that maintains, for a given pressure, a fixed volume that is independent of the volume of the container.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Negative Space: As used in this disclosure, negative space is a method of defining an object through the use of open or empty space as the definition of the object itself, or, through the use of open or empty space to describe the boundaries of an object.

Normal Temperature and Pressure: As used in this disclosure, normal temperature and pressure refers to gas storage conditions corresponding to 20 degrees C. at 100 kPa (approx. 1 atmosphere). Normal temperature and pressure is often abbreviated as NTP.

Nozzle: As used in this disclosure, a nozzle is a device that receives fluid under pressure and releases the fluid in a controlled manner into an environment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Phase Change Terminology: As used in this disclosure, the following terms are used to describe a phase change. A phase change from a solid phase to a liquid phase is called melting. A phase change from a liquid phase to a solid phase is called freezing or solidification. A phase change from a solid phase to a gas phase is called sublimation. A phase change from a gas phase to a solid phase is called deposition. A phase change from a liquid phase to a gas phase is called evaporation. A phase change from a gas phase to a liquid phase is called condensation. A phase change from a gas phase to a plasma phase is called ionization. A phase change from a plasma phase to a gas phase is called recombination.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reduction-Oxidation Reaction: As used in this disclosure, a reduction-oxidation reaction (also known as a redox reaction) is a chemical reaction involving the transfer of electrons between the reactants of the reaction.

Reservoir: As used in this disclosure, a reservoir refers to a container or containment system that is configured to store a liquid.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Solid: As used in this disclosure, a solid refers to a state (phase) of matter that: 1) has a fixed volume; and, 2) does not flow.

Spacer: As used in this disclosure, a spacer is a prism-shaped disk that is formed with a cylindrical negative space that allows a shaft to be inserted through the faces of the disk structure of the spacer. A spacer is further defined with an inner diameter. A spacer is often referred to as a washer. A spacer formed from an elastic material is called an o-ring.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Valve: As used in this disclosure, a valve is a device that is used to control the flow of a fluid (gas or liquid) through a pipe, tube, or hose.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will H readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lighter comprising
wherein the lighter comprises a housing structure, a fuel system, and an ignition circuit;
wherein the housing structure contains the fuel system and the ignition circuit;
wherein the ignition circuit comprises a booster coil circuit, an ignition switch, an arc gap, and a battery;
wherein the booster coil circuit is an electric circuit that electrically connects to the ignition switch;
wherein the booster coil circuit receives and stores electric energy from the battery;
wherein the booster coil circuit receives a voltage from the battery;
wherein the received electric energy is stored at a voltage greater than the voltage of the battery;
wherein the booster coil circuit discharges the stored electric energy through the ignition switch into the arc gap;
wherein the voltage of the electric energy stored by the booster coil circuit is selected such that the electric energy will ionize the atmosphere when the electric energy is discharged through the arc gap;
wherein the ionization of the atmosphere by the electric energy released by the booster coil circuit ignites the gas phase fuel that has evaporated into the atmosphere to initiate the combustion reaction and the associated flame.

2. The lighter according to claim 1
wherein the lighter is an ignition device;
wherein the fuel system provides the ignition circuit with a supply of a hydrocarbon based fuel;
wherein the ignition circuit provides the fuel with a source of plasma that is used to initiate a combustion reaction that converts the fuel into a flame;
wherein the ignition circuit continuously provides the plasma to the fuel to ensure that the flame is continuously sustained;
wherein the flame is a structure characteristic of a combustion reaction.

3. The lighter according to claim 2
wherein the fuel system is a mechanical system;
wherein the fuel system is a fluid storage and transport system;
wherein the fuel system stores fuel under pressure and in a liquid phase;
wherein the fuel system transports and releases the fuel in a gas phase into a burner well of the housing structure for combustion.

4. The lighter according to claim 3
wherein the ignition circuit is an electric circuit;
wherein the ignition circuit ignites the flow of the fuel to generate the flame of the combustion reaction;
wherein the ignition circuit ignites the fuel using a plasma flow known as an arc;
wherein the ignition circuit passes the arc through the flow of the fuel;
wherein the arc generated by the ignition circuit ensures that the fuel discharged from the fuel system is completely consumed in the combustion reaction.

5. The lighter according to claim 4
wherein the housing structure comprises a shell, a lever, and the burner well;
wherein the shell is a rigid structure;
wherein the shell forms the exterior surfaces of the housing structure;
wherein the lever attaches to the exterior surface of the shell;
wherein the burner well is a disk-shaped negative space that is formed within the shell.

6. The lighter according to claim 5
wherein the shell comprises a reservoir, a valve, and a nozzle;
wherein the valve forms a fluidic connection between the reservoir and the nozzle.

7. The lighter according to claim 6
wherein the booster coil circuit, the ignition switch, the arc gap, and the battery are electrically connected in a series circuit.

8. The lighter according to claim 7
wherein the lever is a mechanical structure;
wherein the lever initiates the flow of fuel through the fuel system;
wherein the lever further initiates the operation of the ignition circuit.

9. The lighter according to claim 8
wherein the burner well is accessible from the exterior of the shell;
wherein the burner well is positioned such that the gas phase fuel released from the fuel system discharges into the burner well;
wherein the burner well is positioned such that the plasma arc generated by the ignition circuit ignites the fuel as the fuel flows into the burner well.

10. The lighter according to claim 9
wherein the reservoir is a containment vessel;
wherein the reservoir further comprises the fuel;
wherein the reservoir stores the fuel in a liquid phase;
wherein the reservoir stores the fuel under pressure.

11. The lighter according to claim 10
wherein the fuel is a hydrocarbon based substance;
wherein the fuel is selected such that the fuel has a gas phase under normal temperature and pressure conditions;
wherein the fuel is stored as a liquid under pressure;
wherein the fuel evaporates to a gas phase when exposed to the atmosphere.

12. The lighter according to claim 11
wherein the valve is a mechanically operated valve;
wherein the valve controls the flow of fuel to the nozzle;

wherein the valve rotates between a closed position and an open position;

wherein the valve permits the flow of fuel from the reservoir to the nozzle when the valve is in an open position;

wherein the valve prevents the flow of fuel from the reservoir to the nozzle when the valve is in a closed position;

wherein the valve mechanically attaches to the lever;

wherein the rotation of the lever to a previously determined position actuates the valve to the open position;

wherein the rotation of the valve away from the operating position actuates the valve to the closed position;

wherein a pressure of the fuel within the reservoir provides motive forces that drive the fuel through the valve and into the nozzle.

13. The lighter according to claim 12 wherein the nozzle is a port of the fuel system that discharges the fuel into the burner well of the housing structure;

wherein the nozzle is formed to create a pressure drop in the fuel as the fuel is discharged into the atmosphere;

wherein the pressure drop through the nozzle causes the fuel to evaporate from a liquid phase into a gas phase as the fuel is discharged from the nozzle.

14. The lighter according to claim 13 wherein the ignition switch is a momentary switch;

wherein the ignition switch forms an electric connection between the booster coil circuit and the arc gap;

wherein the ignition switch controls the flow of electricity from the booster coil circuit into the arc gap;

wherein the ignition switch actuates between a closed position and an open position;

wherein the ignition switch permits the flow of electricity from the booster coil circuit from the arc gap when the ignition switch is in a closed position;

wherein the ignition switch prevents the flow of electricity from the booster coil circuit from the arc gap when the ignition switch is in an open position;

wherein the ignition switch mechanically attaches to the lever;

wherein the rotation of the lever to a previously determined "operating" position actuates the ignition switch to the closed position;

wherein the rotation of the ignition switch away from the operating position actuates the ignition switch to the open position.

15. The lighter according to claim 14 wherein the arc gap is formed from two leads that are exposed to the atmosphere in the burner well of the housing structure;

wherein the arc gap presents the electric energy from the booster coil circuit to the atmosphere in the burner well;

wherein the presentation of the voltage across the arc gap ionizes the atmosphere causing an arc to form across the arc gap;

wherein the arc formed across the arc gap ignites the gas phase fuel;

wherein the arc gap forms an electrical connection between the ignition switch and the battery.

16. The lighter according to claim 15 wherein the battery is an electrochemical device;

wherein the battery converts chemical potential energy into electrical energy used to power the ignition circuit.

17. The lighter according to claim 16 wherein the nozzle further comprises a nozzle pan, a reservoir port, an o-ring, a washer, a mesh filter, and a pinhole ring;

wherein the nozzle pan is a pan shaped structure;

wherein the nozzle pan forms the primary exterior surface of the nozzle;

wherein the nozzle pan contains the reservoir port, the o-ring, the washer, the mesh filter, and the pinhole ring;

wherein the nozzle receives the fuel in a liquid phase from the valve into the nozzle pan through the reservoir port;

wherein the o-ring is a spacer;

wherein the o-ring is an elastomeric structure;

wherein the o-ring forms a fluid impermeable seal around the reservoir port that prevents the escape of fuel from the reservoir port;

wherein the washer is a spacer;

wherein the washer is a rigid structure;

wherein the washer supports the mesh filter such that the fuel flows through the washer to reach the mesh filter;

wherein the mesh filter is a filter;

wherein the mesh filter acts as a strainer that removes solids from the fuel flow before the fuel reaches the pinhole ring;

wherein the pinhole ring is a disk-shaped structure;

wherein the pinhole ring forms a plate that encloses the open face of the pan structure of the nozzle pan;

wherein the pinhole ring has an aperture characteristic of a ring structure;

wherein the diameter of the characteristic aperture of the pinhole ring is selected such that the pressure drop experienced by the fuel as the fuel passes through the pinhole ring causes the fuel to evaporate into the atmosphere.

* * * * *